US006067083A

United States Patent [19]

Glen et al.

[11] Patent Number: 6,067,083

[45] Date of Patent: May 23, 2000

[54] METHOD AND APPARATUS FOR PROCESSING VIDEO DATA UTILIZING A PALETTE DIGITAL TO ANALOG CONVERTER

[75] Inventors: David Glen, North York; Gord Caruk, Bramalea; Raj Verma, Scarborough; Keith Lee, Markham, all of Canada

[73] Assignee: ATI Technologies, Inc, Thornhill, Canada

[21] Appl. No.: 09/033,283

[22] Filed: Mar. 2, 1998

[51] Int. Cl.[7] ..... G09G 5/00

[52] U.S. Cl. ..... 345/213

[58] Field of Search ..... 345/213

[56] References Cited

U.S. PATENT DOCUMENTS 5,861,879 1/1999 Shimizu et al. ..... 345/213

*Primary Examiner*—Richard A. Hjerpe
*Assistant Examiner*—Kevin M. Nguyen
*Attorney, Agent, or Firm*—Markison & Reckamp, PC.

[57] ABSTRACT

A method and apparatus for processing video graphics utilizing less power is accomplished by providing a clock circuit that generates a clock signal. The clock signal is fed to a synchronization circuit that generates horizontal and vertical retrace. The clock signal is also provided to a look-up table DAC (digital to analog converter), or a palette DAC. While the video graphics circuit is processing data for display, the clock circuit provides the clock signal to the both the look-up table DAC and the synchronization circuit. When the data being processed is non-video data (i.e., the horizontal and vertical synchronization information), the clock circuit ceases to provide the clock signal to the look-up table DAC, which disables the look-up table DAC. Thus, it is not consuming power. The clock circuit again provides the clock signal to the look-up table DAC when the data being processed is video data (i.e., the data that is to be displayed).

14 Claims, 4 Drawing Sheets

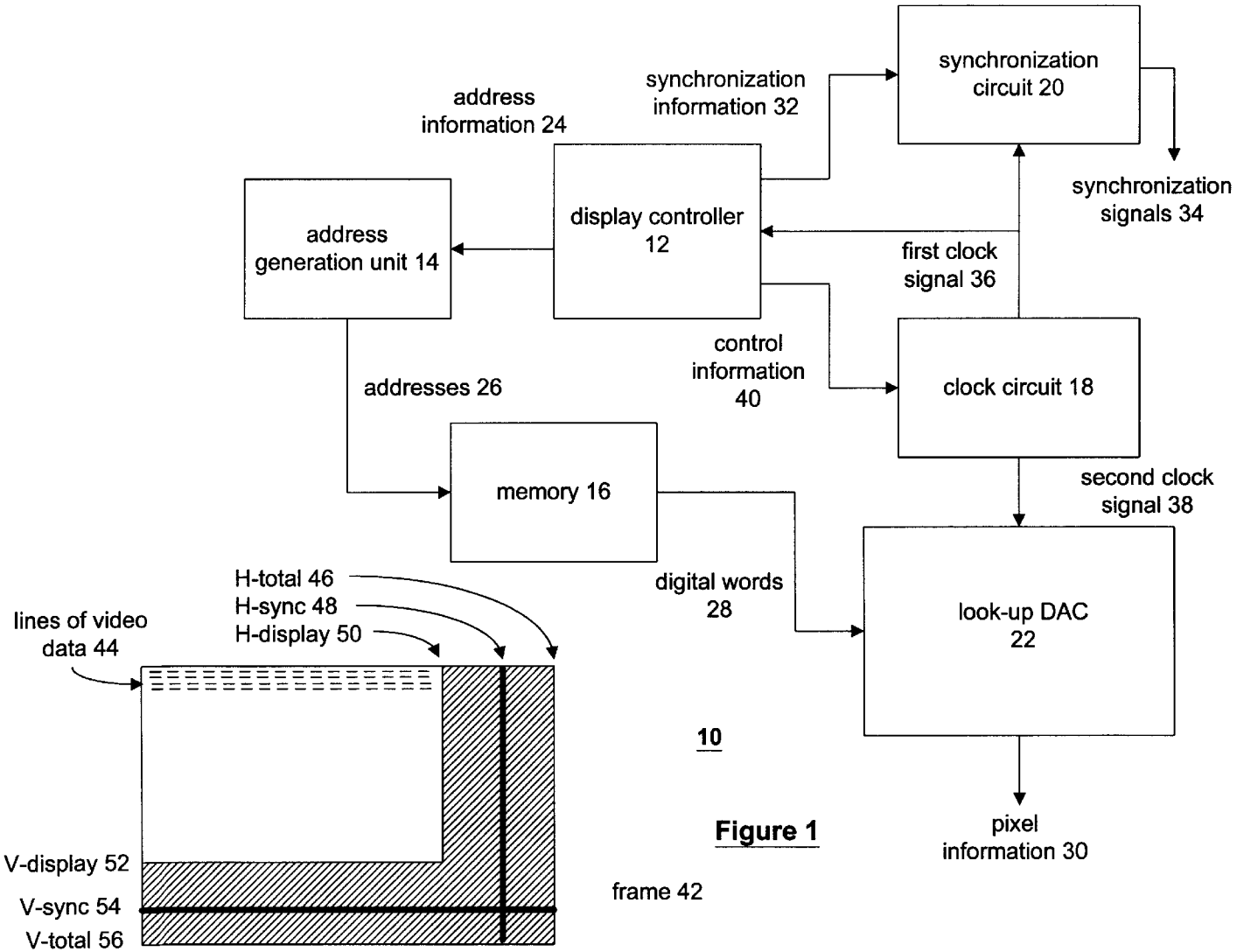
synchronization circuit 20
synchronization signals 34
first clock signal 36
clock circuit 18
second clock signal 38
look-up DAC 22
pixel information 30
synchronization information 32
display controller 12
control information 40
digital words 28
10
Figure 1
address information 24
memory 16
frame 42
address generation unit 14
addresses 26
H-total 46
H-sync 48
H-display 50
lines of video data 44
V-display 52
V-sync 54
V-total 56 video graphics processing circuit 90

METHOD AND APPARATUS FOR PROCESSING VIDEO DATA UTILIZING A PALETTE DIGITAL TO ANALOG CONVERTER

TECHNICAL FIELD OF THE INVENTION

This invention relates generally to video graphics circuits and more particularly to selective enabling of a palette DAC in video graphics circuits to reduce power consumption of a video graphics circuit.

BACKGROUND OF THE INVENTION

It is a never-ending design challenge to reduce power consumption for all types of products. The design challenge is even greater for portable devices such as laptop computers, pagers, cellular telephones, etc. In such devices, power saving techniques are balanced with advanced feature sets that consume power. Typically, the more advance the feature sets that a portable device supports, the more power it consumes. Thus, design engineers of portable devices are constantly working to reduce the power consumption of advanced feature sets with minimal affects on the performance of the feature set.

In general, video graphics circuits, which are utilized in portable computers, personal computers, television sets, and computer game devices, continually process pixel information from video data. This is true regardless of whether the raster is in the active display area (i.e., there is video data to be processed) or when the raster is in an inactive overhead area, which is required for synchronization signals and retrace times. As is known, the video data consists of a plurality of lines, which make up a frame (or field for interlaced display) of video, and may be for two-dimensional graphics, three-dimensional graphics, still images captured by a camera, and/or moving images captured by a camera. One frame/field of video data provides a display screen worth of information for one cycle of the image rate of the display. For example, if the image rate is sixty (60) frames/fields per second, the frame/field is presented for one-sixtieth of a second. The plurality of lines includes the video information (i.e., the information that will be presented on the screen), horizontal retrace, and vertical retrace (i.e., the overhead information). The horizontal retrace is used to provide horizontal synchronization of the video display and the vertical retrace is used to provide vertical synchronization of the video display.

In typical video processing circuits, when the horizontal retrace and vertical retrace are occurring, the pixel generation circuit of the video graphics circuit is still active with a running clock even though no video data will be displayed. Since the horizontal retrace and the vertical retrace account for significant portion of the frame/field time (e.g., up to 25% or more), the pixel generation circuit is overworked by a corresponding percentage. As such, the power consumed by the pixel generation circuit during the horizontal and vertical retraces is wasted energy, resulting in a non-optimum video graphics circuit.

Therefore, a need exists for a method and apparatus that reduces power consumption in video graphics circuitry by selectively disabling the pixel generation circuit.

BRIEF DESCRIPTION OF THE DRAWINGS

FIG. 1 illustrates a schematic block diagram of a video graphics processing circuit, which is in accordance with the present invention;

DETAILED DESCRIPTION OF A PREFERRED EMBODIMENT

Figure 2:
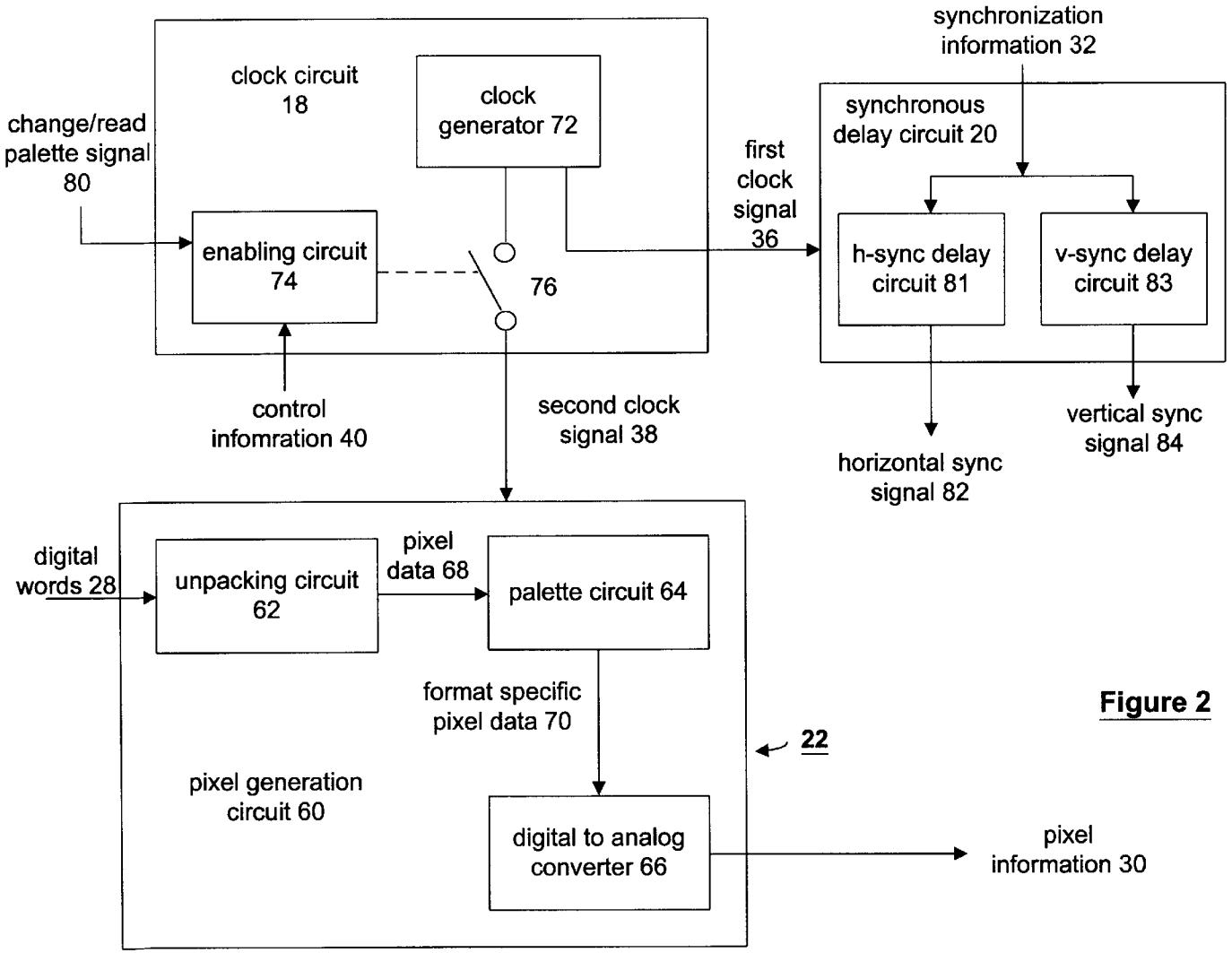
FIG. 2 illustrates a schematic block diagram of a portion of the video graphics circuit of FIG. 1.

Generally, the present invention provides a method and apparatus for processing video data utilizing less power. This may be accomplished by providing a clock circuit that generates a clock signal. The clock signal is fed to a display controller and synchronization circuits that generate horizontal and vertical retraces. The clock signal is also provided to a look-up table DAC (digital to analog converter), or a palette DAC. While the video graphics circuit is processing video data (i.e., the data that is to be displayed), the clock circuit provides the clock signal to the both the look-up table DAC and the display controller and the synchronization circuits. When the data being processed is non-video data (i.e., the horizontal and vertical retrace, or overhead, information), the clock circuit ceases to provide the clock signal to the look-up table DAC, thereby disabling it and reducing its power consumption. The clock circuit resumes supplying the clock signal to the look-up table DAC when the video data is again being processed or for host system processing. By disabling the look-up DAC when non-video data is being processed, its power consumption is reduced proportionately, thereby making video graphics circuits more efficient.

The present invention can be more fully described with reference to FIGS. 1 through 4. FIG. 1 illustrates a schematic block diagram of a video graphics processing circuit 10 that includes a display controller 12, an address generation unit 14, memory 16, a panel module 17, a clock circuit 18, a television encoder 19, a synchronization circuit 20, a digital to analog converter 21, a look-up table 22, and a CRT 23. The display controller 12 may be an integral part of the video graphics circuit 10 or a stand-alone microprocessor, microcontroller, digital signal processor, or any other device that manipulates digital information based on programming instructions, or a portion of such a device. Note that the panel module 17, television encoder 19, and the DAC 21 provide the information from the look-up table 22 to a respective displaying element. For example, the panel module 17 provides the data to an LCD panel display (not shown). Further note that the DAC 21 may be an integral part of the look-up table 22 forming a look-up DAC.

In operation, the display controller 12 generates address information 24, synchronization information 32, and control information 40. The display controller 12 provides the address information 24 to the address generation unit 14, which, in turn, generates addresses 26 therefrom and provides the addresses 26 to the memory 16, which may be random access memory, cache memory, or any other device that stores digital information. Note that, memory 16 may be internal or external to the video graphics circuit 10 and is generally referred to as a frame buffer that stores at least a frame, or field, of video data. For example, a display frame 42 is shown in the lower left hand portion of FIG. 1. The frame 42 includes a plurality of video data lines 44, which itself includes video data 45 and non-video data 47. The video data 45 contains video information that will be displayed on a display device such as a CRT monitor, television, LCD panel, etc. The non-video data 47 includes vertical blanking information and horizontal blanking information, which is used to synchronize the displaying of the video data 45. The horizontal blanking information includes at least one of: an H display value 50, an H total value 46, and a horizontal blanking, or synchronization, signal 48. The vertical blanking information includes at least one of: a video display value 52, a vertical total value 56, and a vertical blanking, or synchronization, signal 54. The format of the video data 45 and the non-video data 47 is well known in the art, thus no further discussion will be presented except to facilitate the understanding of the present invention.

When the display controller 12 is generating address information 24, it is requesting that the address generation unit 14 generate addresses 26 to retrieve particular line(s) of video data 44 from memory 16. The retrieved line(s) of video data 44 appears as digital words 28 (e.g., pixel words) that are provided to the look-up DAC 22. The look-up DAC 22, which will be described in greater detail with reference to FIG. 2, generates pixel information 30 from the received digital words 28. The pixel information 30 is subsequently provided to a video display such that it may be displayed.

The display controller 12 also generates the synchronization information 32, which is provided to the synchronization circuit 20. The synchronization circuit 20 utilizes the synchronization information to generate synchronization signals 34 that have the format and time relative to video data required for each display time and mode. The synchronization signals 34 are used to establish the H total signal 46, the H blanking signal 48, the H display signal 50, the vertical display signal 52, the vertical blanking signal 54, and the vertical total signal 56. Such synchronization is generally understood in the art and will not be further discussed except to illustrate the functionality of the present invention.

The display controller 12 further generates control information 40, which is provided to the clock circuit 18. The clock circuit 18 generates a first clock signal 36 and a second clock signal 38 in partial response to the control information 40. Both the first and second clock signals have essentially the same clock rate, or an integer multiple relationship, but the second clock signal 38 is periodically disabled by the control signal 40. Typically, the control signal 40 will disable the second clock signal 38 when the non-video data 47 is being retrieved from memory 16. With the second clock signal 38 disabled, the look-up table DAC 22 is inoperative while the non-video data 47 is being retrieved. By rendering the look-up table DAC inoperative, it is not consuming much power. Thus, the overall power consumption of the video graphics circuit 10 is reduced.

FIG. 2 illustrates a schematic block diagram of a portion of the video graphics circuit 10. The schematic block diagram includes the clock circuit 18, the synchronization delay circuit 20, and the look-up table DAC 22, which is depicted as a pixel generation circuit 60. The clock circuit 18 includes a clock generator 72, an enabling circuit 74, and a gatable switch 76. The gatable switch 76 may be a switch, a logic circuit, an AND gate, or any other device that gates signals based on another signal. The clock generation circuit 72 generates the first clock signal 36 and the second clock signal 38 to have essentially the same clock rate, or to have an integer relationship. The clock rate is typically in the range of 10 megahertz to several hundred megahertz. The enabling circuit 74 is a logic circuit that receives a change palette signal 80 and the control information 40. Based on these inputs, the enable circuit 74 opens or closes switch 76. The switch will be closed, i.e., providing the second clock signal 38 to the pixel generation circuit 60, when the raster is in non-blanking areas and the digital words contain valid video data 45. Once the raster moves into blanking areas and the video digital words 28 contain non-valid video data, the enabling circuit 74 opens switch 76. Alternatively, the enabling circuit 74 may open switch 76 when the horizontal count value 78 exceeds a predetermined value, such as the H display value 50. When the digital words wraparound to a new line, the enabling circuit again closes switch 76.

While switch 76 is opened, the enabling circuit 74 may receive the change or read palette signal 80, which provides an indication that the color parameters of the pixel information 30 are to be read and/or altered. The change/read palette signal 80 is also provided to the palette circuit 64 of pixel generation circuit 60 to effectuate the change. When the enabling circuit 74 receives the change palette signal 80, it closes switch 76 such that the pixel generation circuit 60 may process the palette change/read request.

The synchronization delay circuit 20 is shown to include a horizontal sync circuit 81 and a vertical sync circuit 83. Based on the first clock signal 36 and synchronization information 32, the horizontal sync circuit 81 generates a horizontal sync 82 while the vertical sync circuit 83 generates a vertical sync signal 84.

The pixel generation circuit 60 includes an unpacking circuit 62, a palette circuit 64, and a digital to analog converter 66. Note that the pixel generation circuit 60 may further include logic (not shown) for processing hardware cursors, video overlays, sprites, overscan, and color space conversion. The unpacking circuit 62 receives the digital words 28, which typically contain 32 to 128 bits per word, and converts the digital words into 8 to 32 bits per pixel data. Such unpacking of digital words is generally known in the art, thus no further discussion will be presented except to further illustrate the present invention. The pixel data 68 is provided to the palette circuit 64, which generates format specific pixel data 70 therefrom. The format specific pixel data 70 is based on the particular type of display. For example, the format of the pixel data 70 will vary depending on whether a CRT is the display unit, an LCD panel, or other type of video display. The format specific pixel data 70 is then converted from a digital signal to an analog signal by digital-to-analog converter 66. The analog output is pixel information 30, which is provided to particular display device.

Figure 3:
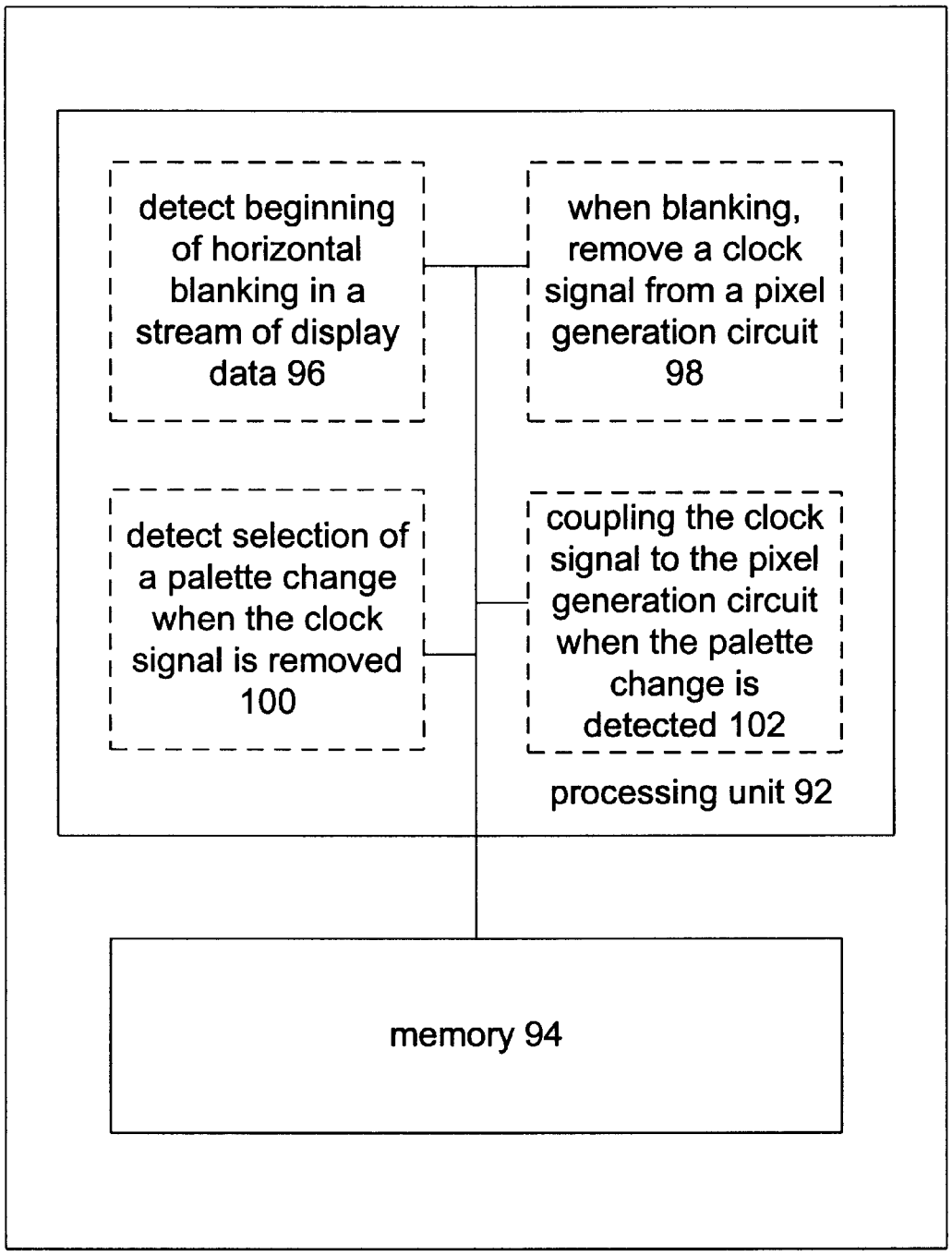
FIG. 3 illustrates a schematic block diagram of an alternate video graphics processing circuit which is in accordance with the present invention.

FIG. 3 illustrates a schematic block diagram of a video graphics processing circuit 90 that includes a processing unit 92 and memory 94. The processing unit 92 may be a microprocessor, a microcontroller, a digital signal processor, a microcomputer, a central processing unit, or any other device that manipulates digital information based on programming instructions. The memory 94 may be a read-only memory, random access memory, CD ROM memory, hard drive memory, floppy disk memory, magnetic tape memory, or any other device that stores digital information.

The memory 94 stores programming instructions that, when read by the processing unit 92, causes the processing unit to function as a plurality of circuits 96–102. When executing the programming instructions, the processing unit 92 functions as a circuit 96 to detect the beginning of horizontal blanking in a stream of display data. When the blanking is detected, the processing unit 92 then functions as circuit 98 to remove a clock signal from the pixel generation circuit. Having done this, the processing unit 92 functions as circuit 100 that detects selection of a palette change when the clock signal is removed. The processing unit 92 then functions as circuit 102 to couple the clock signal to the pixel generation circuit when the palette change or read is detected. The functionality of the processing unit 92, while performing the programming instructions stored in memory 94 will be discussed in greater detail with reference to FIG. 4.

Figure 4:
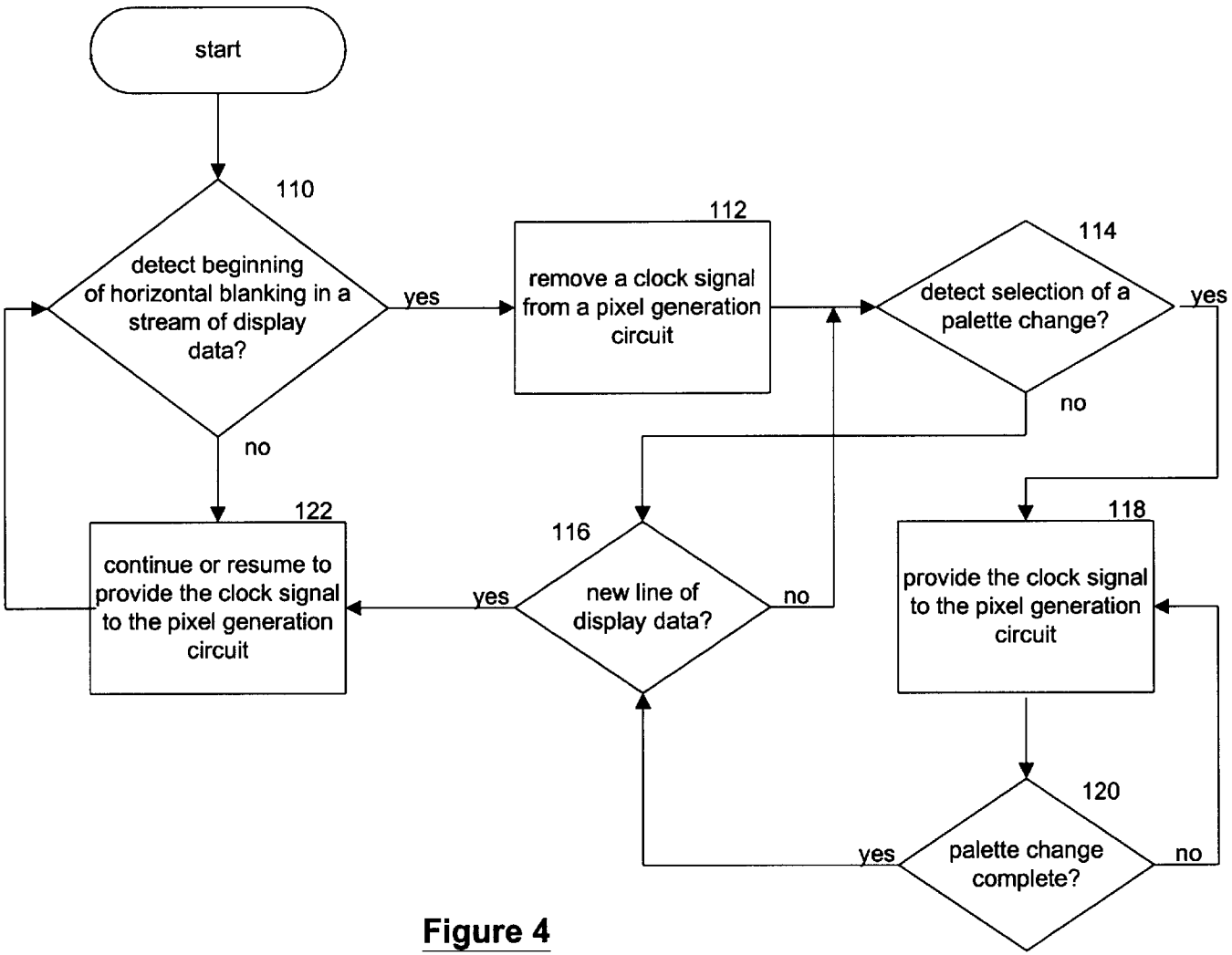
FIG. 4 illustrates a logic diagram of a method for processing video data in accordance with the present invention.

FIG. 4 illustrates a logic diagram of a method for processing video data in a reduced power consumption manner. The process beings at step 110 where a determination is made as to whether the beginning of horizontal blanking in a stream of data is detected. Horizontal blanking is detected by monitoring the stream of display data, or digital words, for blanking information, i.e., the non-video data 47. Alternatively, the detection of blanking information may be done by determining that the horizontal count value exceeding the horizontal display value.

If the horizontal blanking is detected, the process proceeds to step 112. At step 112, a clock signal is removed from the pixel generation circuit. The clock signal may be removed from the pixel generation circuit by disabling the clock circuit or by decoupling the clock signal. The process then proceeds to step 114 where a determination is made as to whether a selection of palette change/read (i.e., a request to read and/or change the palette) has been detected. Note that steps 112 and 114 could be done simultaneously or in reverse order. If a palette change/read is detected, the process proceeds to step 118 where the clock signal is again provided to the pixel generation circuit such that it may process the palette change. Having done this, the process proceeds to step 120 where a determination is made as to whether the palette change has been completed. If not, the clock signal is provided to the pixel generation circuit as described in step 118.

If, however, the palette change has been completed, the process proceeds to step 116. At step 116, a determination is made as to whether a new line of display data is being received. If not, the process reverts to step 114 where a determination is made as to whether the selection of a palette change has occurred. If the data is not a new line or a palette change has not been selected, the process waits until either a new line of display data is being received or a palette change occurs. Once a new line of data has been detected, the process proceeds to step 122 where the clock signal is continually provided to the pixel generation circuit. The clock signal is also provided to the pixel generation circuit when the determination at step 110 is negative.

The preceding discussion has presented a method and apparatus for processing video information in a reduced power consumption circuit. Removing a clock signal from the pixel generation circuit when the video processing circuit is receiving blanking information, or non-video data reduces the power consumption. The blanking periods typically represent approximately twenty to twenty-five (20–25%) percent of the display frame/field time, thus the power consumption reduction is proportional thereto. If a palette change or read occurs while the clock signal has been removed from the pixel generation circuit, the pixel generation circuit is provided with the clock signal such that it may process the palette change or read. Thus, complete functionality of the video processing circuit is obtained with a significant reduction in power consumption.

What is claimed is:

1. A video graphics processing circuit comprises:

memory for storing display data as digital words;

controller that generates synchronization information, control information, and address information;

address generation unit operably coupled to the controller and the memory, wherein the address generation unit generates addresses based on the address information, wherein the addresses are used to retrieve the digital words from the memory to produce retrieved digital words;

a look-up table DAC operably coupled to receive the retrieved digital words and to produce therefrom pixel information;

a synchronization circuit operably coupled to receive the synchronization information and to produce therefrom synchronization signals; and clock circuit operably coupled to the synchronization circuit and to the look-up table DAC, wherein the clock circuit generates a first clock signal having a first clock rate and a second clock signal having the first clock rate, wherein the first clock signal is provided to the synchronization circuit and the second clock signal is provided to the look-up table DAC, and wherein the clock circuit disables the second clock signal based on the control information.

2. The video graphics processing circuit of claim 1 further comprises, within the look-up table DAC, an unpacking circuit operably coupled to receive the retrieved digital words and to produce therefrom pixel data;

a palette circuit operably coupled to the unpacking circuit, wherein the palette circuit converts the pixel data to format specific pixel data; and a digital to analog converter operably coupled to receive the format specific pixel data and to produce therefrom the pixel information.

3. The video graphics processing circuit of claim 2 further comprises, within the clock circuit, circuitry for enabling, when the digital word contains the blanking information, the second clock signal when a change of palette signal is detected.

4. The video graphics processing circuit of claim 1 further comprises, the clock circuit being operably coupled to receive a horizontal count value, wherein the clock circuit disables the second clock signal when horizontal count value equates a horizontal display value, and enables the second clock signal when the horizontal count value is reset, wherein the horizontal display value indicates when the digital word contains the blanking information.

5. A method for processing display data, the method comprising the steps of:

a) detecting beginning of horizontal blanking in a stream of the display data;

b) when the beginning of the horizontal blanking is detected, removing a clock signal from a pixel generation circuit;

c) detecting selection of a palette change/read while the clock signal is removed from pixel generation circuit; and d) when the palette change/read is detected, coupling the clock signal to the pixel generation circuit to process the palette change/read.

6. The method of claim 5 further comprises, within step (b), removing the clock signal from the pixel generation circuit by disabling the clock signal.

7. The method of claim 5 further comprises, within step (b), removing the clock signal from the pixel generation circuit by de-coupling the clock signal.

8. The method of claim 5 further comprises, within step (d), removing the clock signal from the pixel generation circuit when the palette change/read has been processed.

9. The method of claim 5 further comprises continuously providing the clock signal to a synchronization circuit.

10. A video graphics processing circuit comprises:

a processing unit; and memory that stores programming instructions that, when read by the processing unit, causes the processing unit to (a) detect beginning of horizontal blanking in a stream of the display data; (b) remove a clock signal from a pixel generation circuit when the beginning of the horizontal blanking is detected; (c) detect selection of a palette change while the clock signal is removed from pixel generation circuit; and (d) couple the clock signal to the pixel generation circuit to process the palette change when the palette change is detected.

11. The video graphics processing circuit of claim 10 further comprises, within the memory, programming instructions that, when read by the processing unit, causes the processing unit to remove the clock signal from the pixel generation circuit by disabling the clock signal.

12. The video graphics processing circuit of claim 10 further comprises, within the memory, programming instructions that, when read by the processing unit, causes the processing unit to remove the clock signal from the pixel generation circuit by de-coupling the clock signal.

13. The video graphics processing circuit of claim 10 further comprises, within the memory, programming instructions that, when read by the processing unit, causes the processing unit to remove the clock signal from the pixel generation circuit when the palette change has been processed.

14. The video graphics processing circuit of claim 10 further comprises, within the memory, programming instructions that, when read by the processing unit, causes the processing unit to continuously provide the clock signal to a synchronization circuit.

* * * * *